US010429768B2

(12) United States Patent
Sabo et al.

(10) Patent No.: US 10,429,768 B2
(45) Date of Patent: Oct. 1, 2019

(54) PRINTING LIQUID DEVELOPER

(71) Applicant: HP Indigo B.V., Amstelveen (NL)

(72) Inventors: David Sabo, San Diego, CA (US); Stanley J. Kozmiski, San Diego, CA (US); Guang Jin Li, San Diego, CA (US); John W. Godden, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/748,603

(22) PCT Filed: Jan. 28, 2016

(86) PCT No.: PCT/US2016/015378
§ 371 (c)(1),
(2) Date: Jan. 29, 2018

(87) PCT Pub. No.: WO2017/131701
PCT Pub. Date: Aug. 3, 2017

(65) Prior Publication Data

US 2019/0004452 A1 Jan. 3, 2019

(51) Int. Cl.
*G03G 15/10* (2006.01)
*G03G 15/01* (2006.01)
(Continued)

(52) U.S. Cl.
CPC ..... *G03G 15/101* (2013.01); *G03G 15/0168* (2013.01); *G03G 15/0233* (2013.01); *G03G 15/0818* (2013.01); *G03G 15/10* (2013.01); *G03G 15/11* (2013.01); *G03G 2215/025* (2013.01); *G03G 2215/0658* (2013.01); *G03G 2215/0855* (2013.01); *G03G 2215/1619* (2013.01)

(58) Field of Classification Search
CPC .. G03G 15/10; G03G 15/101; G03G 15/0168; G03G 15/0233; G03G 15/0928
USPC ..... 399/107, 110, 119, 120, 222, 223, 233, 399/237, 239
See application file for complete search history.

(56) References Cited

U.S. PATENT DOCUMENTS 5,887,225 A 3/1999 Bell
7,320,822 B2 * 1/2008 Ashibe ..... G03G 15/0233 399/162

(Continued)

FOREIGN PATENT DOCUMENTS

JP 2003248373 9/2003
JP 2008033248 2/2008
WO WO-2013151562 10/2013

OTHER PUBLICATIONS

Multi-walled carbon nanotubes, UBE Industries, Ltd., Retrieved from the Internet on Dec. 18, 2015, Available online: http://www.ube-ind.co.ip/ube/en/news/2011/2011 05html.

*Primary Examiner* — Hoan H Tran
(74) *Attorney, Agent, or Firm* — Perry + Currier Inc

(57) ABSTRACT

In some examples, a printing liquid developer includes a developer roller that has a hollow tubular base body formed of a material including conductive carbon fiber, a conductive, compliant layer around an outer surface of the hollow tubular base body, and an electrically conductive support separate from the hollow tubular base body and electrically contacted to a surface of the hollow tubular base body.

15 Claims, 4 Drawing Sheets

(51) Int. Cl.

| | |
|---|---|
| ***G03G 15/02*** | (2006.01) |
| ***G03G 15/11*** | (2006.01) |
| ***G03G 15/08*** | (2006.01) |

(56) References Cited

U.S. PATENT DOCUMENTS

| | | | | |
|---|---|---|---|---|
| 7,797,833 | B2 * | 9/2010 | Nakamura | G03G 15/0818 29/895.32 |
| 8,079,943 | B2 | 12/2011 | Kim | |
| 8,103,194 | B2 * | 1/2012 | Patton | G03G 15/104 399/237 |
| 8,396,403 | B2 | 3/2013 | Breitenbach et al. | |
| 9,005,093 | B2 | 4/2015 | Kim et al. | |
| 9,529,298 | B2 * | 12/2016 | Sato | G03G 15/0812 |
| 2002/0025182 | A1 | 2/2002 | Park | |
| 2005/0118421 | A1 | 6/2005 | Ashibe et al. | |
| 2009/0097883 | A1 | 4/2009 | Guzman et al. | |

* cited by examiner

PRINTING LIQUID DEVELOPER

BACKGROUND

A printing system can be used to print an image onto a print target (e.g. media sheet or other target). In an electrophotography (EP) printing system, a selectively charged photoconductive member (e.g. drum) is used, where the photoconductive member is selectively charged based on a target image that is to be formed on a media sheet. Printing liquid is provided from a printing liquid developer to the selectively charged photoconductive drum, where the printing liquid is ultimately transferred to the print target to form the target image.

BRIEF DESCRIPTION OF THE DRAWINGS

Some implementations are described with respect to the following figures.

DETAILED DESCRIPTION

A printing liquid developer is used in a printing system, such as a liquid electro-photography (LEP) printing system, to develop a layer of printing liquid (e.g. ink or other type of printing liquid) onto a photoconductive member (e.g. drum or other member), which is also referred to as a photo-imaging plate (PIP). As used here, the term "printing liquid" can refer to a liquid that includes a combination of liquid and solid. As an example, the liquid can include oil or another type of liquid, and the solid can include a color pigment or some other type of solid.

In an LEP printing system, the printing liquid developer can be referred to as a binary ink developer (BID). The printing liquid developer includes a rotatable developer roller that has a base body and a conductive, compliant layer around an outer surface of the base body. In some examples, the base body is formed of a metal (e.g. aluminum, steel, etc.), and the conductive, compliant layer can be formed of a polymer such as polyurethane. More generally, the conductive, compliant layer is non-metallic, and is deformable in response to contact force applied to the conductive, compliant layer. In some examples, the conductive, compliant layer can have a resistivity in the range between $10^3$ and $10^7$ ohm-centimeter. In other examples, the conductive, compliant layer can have a resistivity in a different range.

Polyurethane can be unstable when cast around a metallic base body, and can exhibit poor adhesion to the metallic base body. The instability of polyurethane when cast around a metallic base body can lead to de-polymerization of the polyurethane layer, while the poor adhesion of polyurethane layer to the metallic base body can cause the polyurethane layer to detach from the metallic base body. In addition, a metallic base body can be heavy, which can increase mechanical wear on a drive mechanism used to rotate the developer roller.

In accordance with some implementations of the present disclosure, a base body of a developer roller is formed of a material that includes conductive carbon fiber. A conductive, compliant layer is mounted around the base body formed of the material that includes conductive carbon fiber. The base body can have a hollow tubular structure. An electrically conductive journal (in the form of a shaft or other support structure), which is separate from the base body, is electrically contacted to the base body to allow for conduction of electrical current through the journal to the base body of the developer roller. The electrically conductive journal can be electrically contacted to an inner surface inside the hollow core of the base body. Although reference is made to an electrically conductive journal in the ensuing discussion, it is noted that other types of electrically conductive supports can be used that are electrically contacted to the base body.

Figure 1:
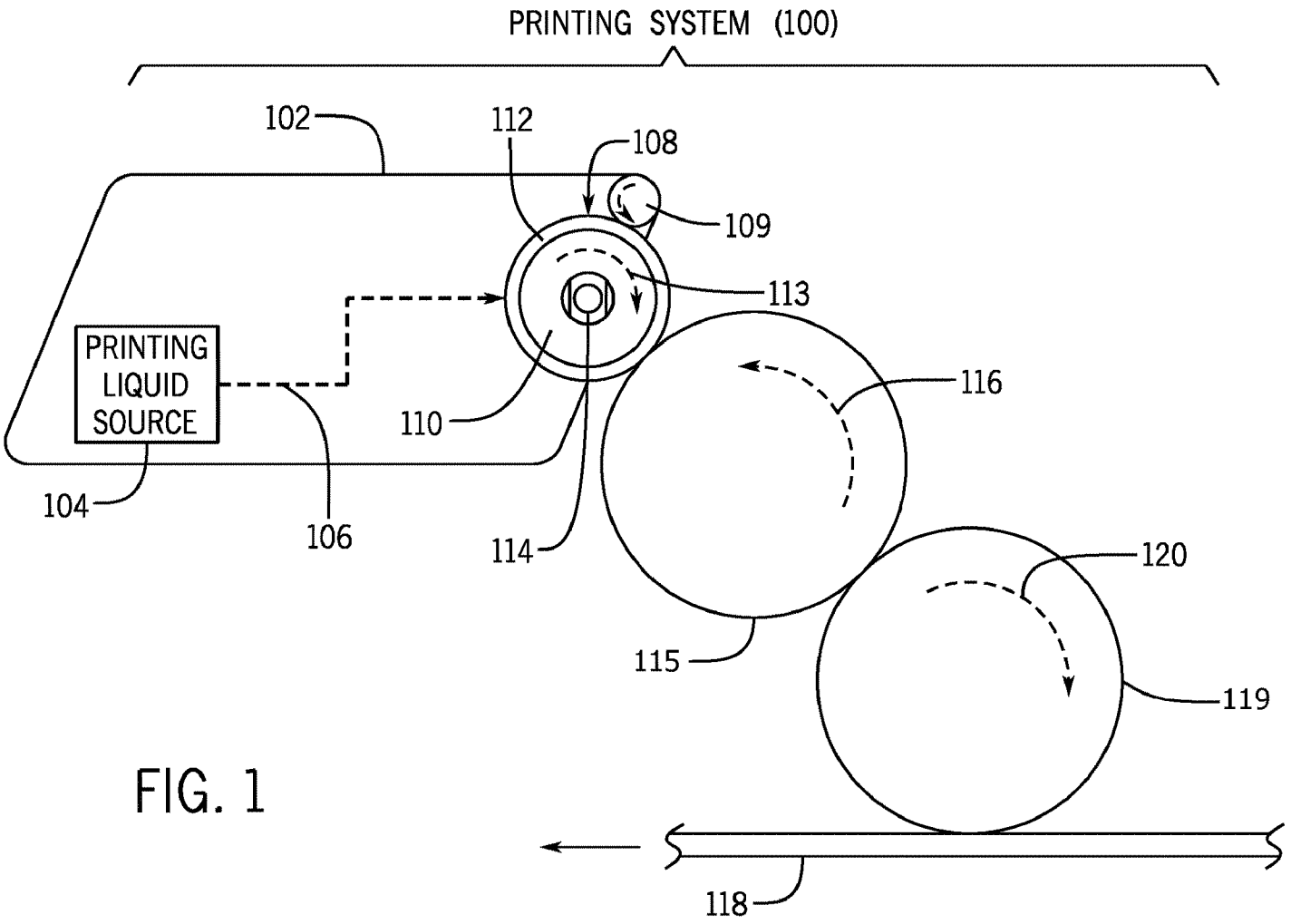
FIG. 1 is a schematic diagram of a portion of an example printing system according to some implementations.

FIG. 1 is a schematic diagram of a portion of an example printing system 100, such as an LEP printing system. The printing system 100 includes a printing liquid developer 102 (e.g. a BID). The printing liquid developer includes a printing liquid source 104 that contains a printing liquid. Printing liquid from the printing liquid source 104 can travel along a path 106 to a developer roller 108, which includes a carbon fiber base body 110 and a conductive, compliant layer 112 around the outer surface of the carbon fiber base body 110. The carbon fiber base body 110 of the developer roller 108 is formed of a material that includes carbon fiber.

It is noted that the path 106 of the printing liquid developer 102 includes various components, including electrodes and other rollers (not shown), to transfer printing liquid from the printing liquid source 104 to the developer roller 108. Note also that any unused printing liquid that remains on the developer roller 108 can be removed by various components in the printing liquid developer 102 that are not shown.

In the example of FIG. 1, the developer roller 108 is rotatable in a first rotational direction 113. The developer roller 108 has a journal 114 (or more generally, a support) that is rotatable to rotate the developer roller 108. In some examples, the printing liquid developer 102 also includes a squeegee roller 109 that is in contact with the developer roller 108.

In the ensuing discussion, reference is made to ink as being an example of a printing liquid. In other examples, other types of printing liquids can be employed.

During a printing operation of the printing system 100, ink that has been transferred to the developer roller 108 coats an outer surface of the conductive, compliant layer 112 of the developer roller 108. The ink that initially coats the outer surface of the conductive, compliant layer 112 can include more liquid than solid. The developer roller 108 can be set at a first electrical potential, which can be a negative electric potential.

The squeegee roller 109 rotates in a rotational direction opposite the rotational direction 113 of the developer roller 108. The squeegee roller 109 can be set at a second electrical potential that is more negative than the first electrical potential at which the developer roller 108 is set, such that the squeegee roller 109 can skim the ink that has been coated on the developer roller 108. As a result of this skimming, the ink that remains on the developer roller 108 can become more solid than liquid.

After skimming, the ink that remains on the developer roller 108 is selectively transferred to a photoconductive drum 115 (also referred to as a PIP) that rotates in a rotational direction 116 that is opposite the rotational direction 113 of the developer roller 108. Although reference is made to a photoconductive drum 115 in the present disclosure, it is noted that in other examples, other types of photoconductive members can be used, such as belts or other transfer members. The photoconductive drum 115 makes contact with the developer roller 108. The photoconductive drum 115 is selectively charged based on a target image that is to be formed on a media sheet 118, such as paper or other substrate onto which a target image can be formed. The ink on the developer roller 108 is transferred to the photoconductive drum 115 to portions of the photoconductive drum 115 that have been charged.

The photoconductive drum 115 makes contact with a blanket drum 119, which rotates along rotational direction 120 that is opposite the rotational direction 116 of the photoconductive drum 115. The blanket drum 119 transfers the ink from the photoconductive drum 115 to the media sheet 118, to form the target image on the media sheet 118.

Figure 2:
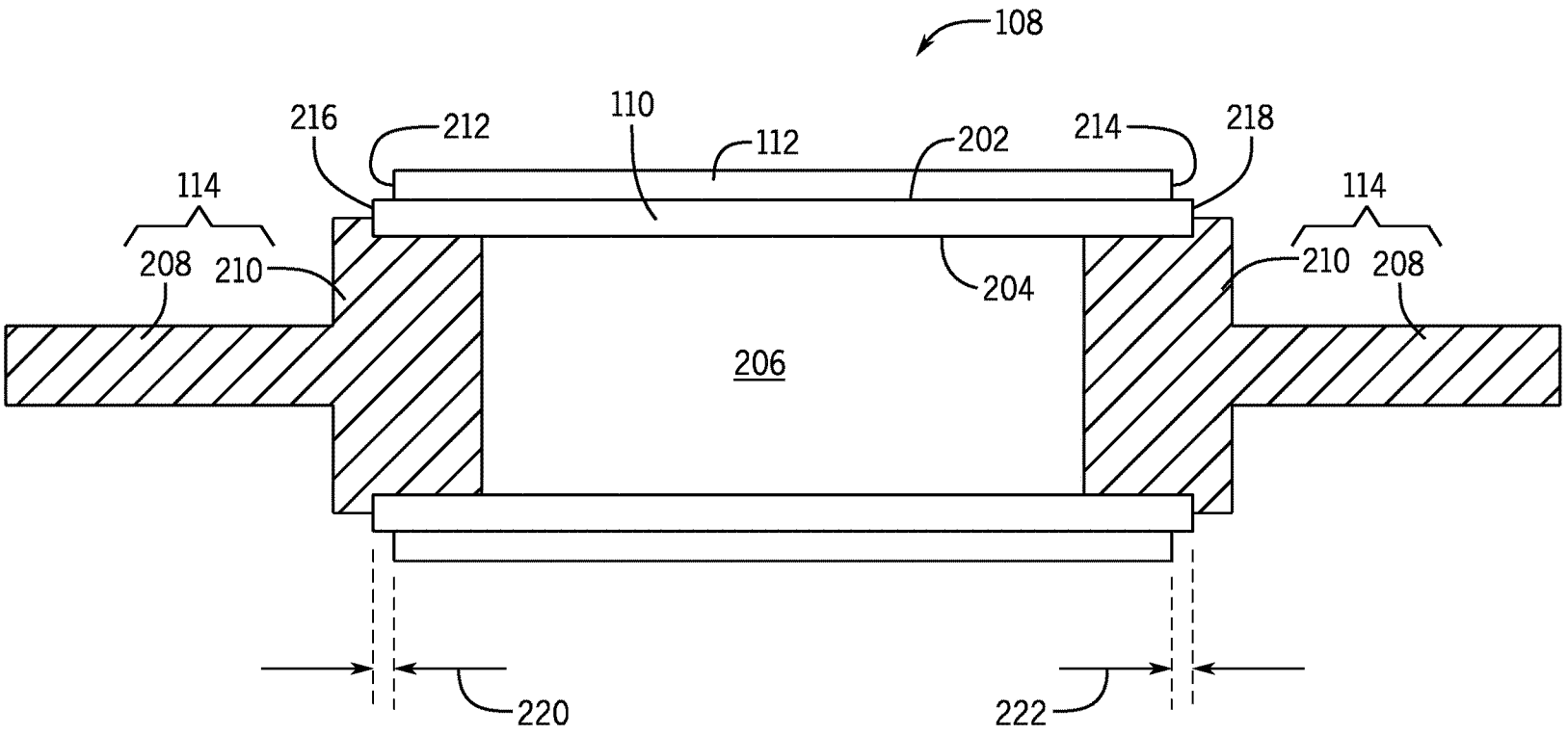
FIG. 2 is a sectional view of a developer roller according to some implementations.

FIG. 2 is a sectional side view of the developer roller 108 according to some implementations. The developer roller 108 includes the base body 110 that has a hollow tubular structure. The hollow tubular structure of the base body 110 can be shaped generally as a cylindrical tube, where the cross-sectional profile can be circular or can have another shape. The conductive, compliant layer 112 is attached on an outer surface 202 of the base body 110. The base body 110 also has an inner surface 204 that defines an inner central bore 206 of the hollow tubular structure of the base body 110.

As further shown in FIG. 2, two journals 114 are attached to the base body 110 on the two respective ends of the base body 110. Each journal 114 includes a shaft 208 and a connecting member 210 that is integrally formed with the shaft 208. The connecting member 210 has a larger diameter than the shaft 208. The connecting member 210 makes physical contact with a corresponding end portion of the base body 110. As shown in FIG. 2, a portion of the connecting member 210 makes contact with the inner surface 204 of the base body 110.

Portions of the inner surface 204 of the base body 110 that are to make contact with the connecting members 210 of the journals 114 can be treated to expose carbon fiber. The exposed carbon fiber provides better electrical contact between the inner surface 204 of the base body 110 and the corresponding connecting member 210 of the journal 114. For example, treating of the portions of the inner surface 204 of the base body 110 can including grinding or sanding such portions to expose the carbon fiber of the base body 110. The grinding or sanding ensures that any insulating material, such as epoxy or other insulating material, is removed from the treated portions of the inner surface 204 of the base body 110 that are in contact with the corresponding connecting members 210 of the journals 114.

Each connecting member 210 can be press fit into the inner bore 206 of the base body 110, with an adhesive layer provided between the connecting member 210 and the base body 110 to form an adhesive bond. In other examples, instead of using adhesive to attach the connecting member 210 to the base body 110, other types of attachment mechanisms can be employed, including screws, and so forth.

By making electrical contact between the journal 114 and the inner surface 204 of the base body 110, an electrical current can be passed through the journal 114 to the base body 110. As noted above, the developer roller 108 is maintained at a specific electrical potential during a printing operation. The transfer of the electrical current through the journal 114 to the base body 110 allows for maintaining the developer roller 108 at this electrical potential.

In some implementations, the outer surface 202 of the base body 110 is also treated to expose the carbon fiber of the base body 110, such that good electrical continuity can be provided between the base body 110 and the conductive, compliant layer 112. The treating of the outer surface 202 of the base body 110 can include grinding or sanding of the outer surface 202.

As further shown in FIG. 2, in accordance with some implementations, the conductive, compliant layer 112 can have a length that is shorter than a length of the base body 110, such that the two ends 212 and 214 of the conductive, compliant layer 112 do not extend past the respective ends 216 and 218 of the base body 110. More specifically, a first end 212 of the conductive, compliant layer 112 is a non-zero distance away from a first end 216 of the base body 110, such that the first end 212 of the conductive, compliant layer 112 is offset from the first end 216 of the base body 110 by an offset distance 220. Similarly, a second end 214 of the conductive, compliant layer 112 is a non-zero distance away from a second end 218 of the base body 110, such that the second end 214 of the conductive, compliant layer 112 is offset from the second end 218 of the base body 110 by an offset distance 222.

As shown in FIG. 2, the ends 212 and 214 of the conductive, compliant layer 112 do not have to wrap around the ends 216 and 218, respectively, of the base body 110, to maintain good adhesion between the conductive, compliant layer 112 and the base body 110. That is because a conductive, compliant layer such as a polyurethane layer has relatively good adhesion to carbon fiber. Because the ends 212 and 214 of the conductive, compliant layer 112 do not extend past the respective ends 216 and 218 of the base body 110, flaring of the conductive, compliant layer 112 at the end portions does not occur, where the flaring can result in enlarged outer diameters of the conductive, compliant layer 112 at the end portions.

Figure 3:
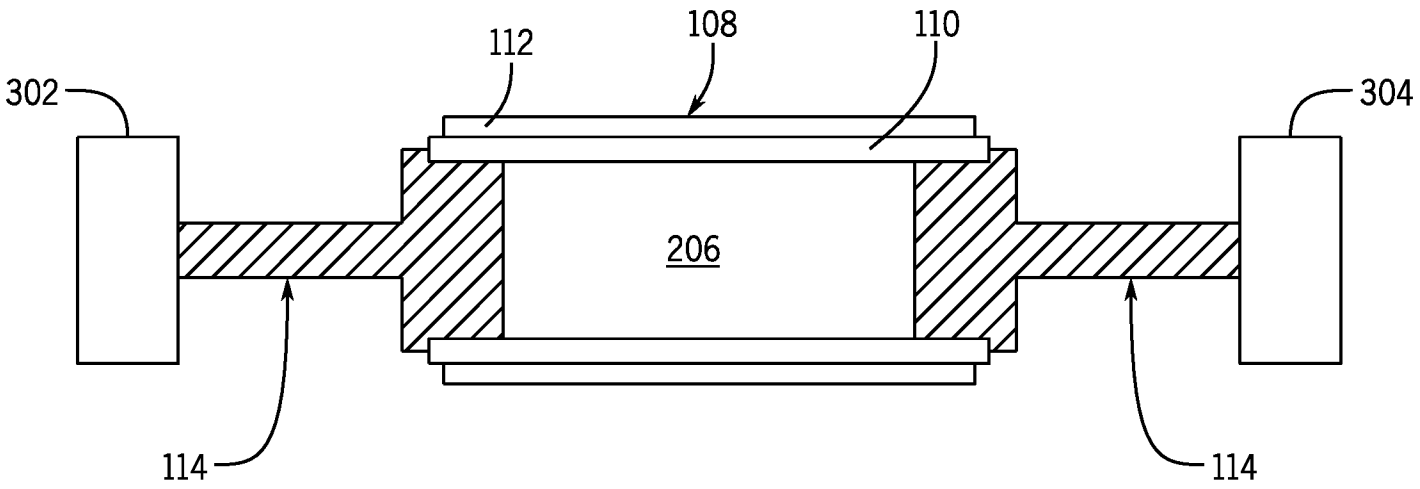
FIG. 3 is a schematic view of a developer roller and drive mechanisms to rotate the developer roller, in accordance with some implementations.

FIG. 3 is a schematic diagram of an example assembly that includes the printing liquid developer 102 operatively coupled to respective drive mechanisms 302 and 304. The drive mechanisms 302 and 304 are operatively connected to the journals 114 of the printing liquid developer 102. One of the drive mechanisms 302 and 304 can be an active drive mechanism to actively rotate the corresponding journal 114, while the other of the drive mechanisms 302 and 304 can be a passive drive mechanism that supports and allows for rotation of the respective journal 114. In other examples, both the drive mechanisms 302 and 304 can be active drive mechanisms.

A mechanism (e.g. a carbon brush or other mechanism) can communicate electrical current through the respective journal(s) 114 to the base body 110 of the printing liquid developer 108. As an example, the carbon brush (which can be electrically coupled to a power supply that supplies the electrical current) can contact the end of a journal 114, or a radial surface of the journal 114. The electrical current communicated to the base body 110 is used to set the base body 110 at a specified electric potential.

The interface between the carbon fiber base body 110 and the conductive, compliant layer 112 is more stable than the interface between a metallic base body and conductive, compliant layer, which reduces the likelihood of ion migration that can cause de-polymerization of the conductive, compliant layer 112. Also, by employing a carbon fiber base body, electro-less nickel plating of the base body does not have to be provided in some examples to address the de-polymerization issue.

Also, enhanced adhesion is provided between the conductive, compliant layer 112 and the carbon fiber base body 110 to reduce the likelihood of detachment of the conductive, compliant layer 112 from the carbon fiber base body 110. In addition, carbon fiber is generally lighter than metal, such that the carbon fiber base body 110 is lighter than a metallic base body, which reduces the weight of the developer roller 108 as well as the overall weight of the printing system.

By using the developer roller 108 with a reduced weight, less stress is placed on a drive mechanism (e.g. 302 and/or 304) used to rotate the developer roller 108, which reduces mechanical wear during operation.

Figure 4:
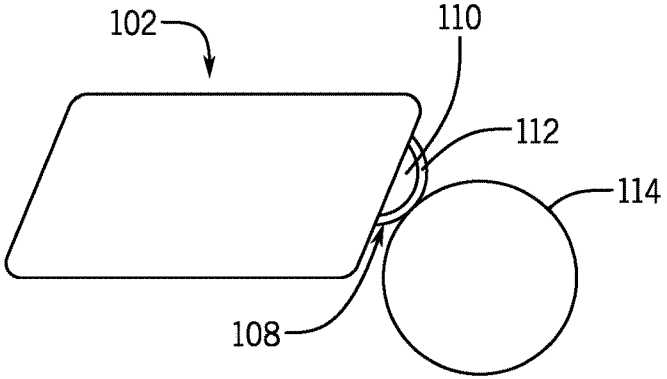
FIG. 4 is a schematic view of a portion of an example printing system according to some implementations.

FIG. 4 is a simplified view of a printing system according to some implementations, which includes the printing liquid developer 102 that includes the developer roller 108 with the carbon fiber base body 110 and conductive, compliant layer 112. As depicted in FIG. 4, the developer roller 108 is in contact with the photoconductive drum 115.

Figure 5:
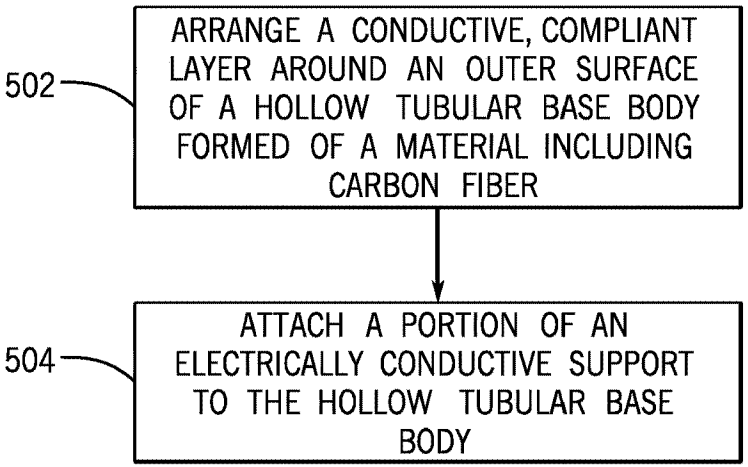
FIG. 5 is a flow diagram of an example process of forming a developer roller according to some implementations.

FIG. 5 is a flow diagram of an example process of forming a printing liquid developer, such as the printing liquid developer 102. The process includes arranging (at 502) a conductive, compliant layer (e.g. 112) around an outer surface of a hollow tubular base body (e.g. 110) formed of a material including carbon fiber. The process further includes attaching (at 504) a portion of an electrically conductive support (e.g. journal 114) to the hollow tubular base body to make electrical contact between the portion of the electrically conductive journal and an inner surface of the hollow tubular base body, where the inner surface of the hollow tubular base body defines an inner bore of the hollow tubular base body, and the electrically conductive journal is separate from the hollow tubular base body.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A printing liquid developer for a printing system, comprising:

a developer roller comprising:

a hollow tubular base body formed of a material comprising conductive carbon fiber;

a conductive, compliant layer around an outer surface of the hollow tubular base body; and an electrically conductive support separate from the hollow tubular base body and electrically contacted to a surface of the hollow tubular base body.

2. The printing liquid developer of claim 1, wherein the electrically conductive support is electrically contacted to an inner surface of the hollow tubular base body, the inner surface defining an inner bore of the hollow tubular base body.

3. The printing liquid developer of claim 2, wherein the inner surface is treated to expose the carbon fiber, the electrically conductive support electrically contacted to the exposed carbon fiber.

4. The printing liquid developer of claim 1, further comprising a printing liquid source to provide the printing liquid to the developer roller.

5. The printing liquid developer of claim 1, wherein the outer surface of the hollow tubular base body is treated to expose the carbon fiber, the exposed carbon fiber to maintain electrical continuity between the hollow tubular base body and the conductive, compliant layer.

6. The printing liquid developer of claim 1, wherein the conductive, compliant layer comprises a polymer.

7. The printing liquid developer of claim 1, wherein the conductive, compliant layer comprises polyurethane.

8. The printing liquid developer of claim 1, wherein the electrically conductive support is for attachment to a drive mechanism to rotate the developer roller, and the electrically conductive support to receive an electrical current to maintain the developer roller at a specified electrical potential.

9. A printing system comprising:

a photoconductive member; and a printing liquid developer to transfer a printing liquid to the photoconductive member, the printing liquid developer comprising:

a tubular base body formed of a material comprising conductive carbon fiber, the tubular base body comprising an inner bore;

a conductive, compliant layer around an outer surface of the tubular base body; and an electrically conductive support separate from the tubular base body and electrically contacted to an inner surface of the tubular base body, the inner surface defining the inner bore.

10. The printing system of claim 9, wherein the electrically conductive support is press fit into the inner bore of the tubular base body.

11. The printing system of claim 10, wherein the inner surface of the tubular base body is treated to expose the carbon fiber, the exposed carbon fiber electrically contacted to a connecting member of the support.

12. The printing system of claim 9, wherein the printing liquid developer is a binary ink developer (BID).

13. The printing system of claim 9, wherein the photoconductive member is selectively chargeable based on a target image to be formed by the printing system on a media sheet.

14. A method of forming a printing liquid developer, comprising:

arranging a conductive, compliant layer around an outer surface of a hollow tubular base body formed of a material comprising carbon fiber; and attaching a portion of an electrically conductive support to the hollow tubular base body to make electrical contact between the portion of the electrically conductive support and an inner surface of the hollow tubular base body, the inner surface of the hollow tubular base body defining an inner bore of the hollow tubular base body, and the electrically conductive support being separate from the hollow tubular base body.

15. The method of claim 14, further comprising:

treating a portion of the inner surface of the hollow tubular base body to expose the carbon fiber, the treated portion of the inner surface of the hollow tubular base body electrically contacted to the portion of the electrically conductive support, wherein the treating comprises grinding or sanding the portion of the inner surface.

* * * * *